United States Patent [19]

Phillips

[11] 4,179,207

[45] Dec. 18, 1979

[54] DAYLIGHT LOADER COVER DEVICE FOR PHOTOGRAPHIC PRINTING MACHINE

[76] Inventor: E. W. Phillips, P.O. Box 42, Hixson, Tenn. 37343

[21] Appl. No.: 124

[22] Filed: Jan. 2, 1979

[51] Int. Cl.[2] ..... G03D 17/00

[52] U.S. Cl. ..... 354/308

[58] Field of Search ..... 354/307, 308, 309, 310

[56] References Cited

U.S. PATENT DOCUMENTS

| | | | |
|---|---|---|---|
| 908,892 | 1/1909 | Sekinger | 354/308 |
| 1,074,373 | 9/1913 | Masko | 354/308 |
| 3,826,300 | 7/1974 | Lee | 354/308 |

FOREIGN PATENT DOCUMENTS

| | | | |
|---|---|---|---|
| 2326091 | 12/1973 | Fed. Rep. of Germany | 354/308 |
| 924477 | 4/1963 | United Kingdom | 354/308 |

*Primary Examiner*—L. T. Hix
*Assistant Examiner*—Alan Mathews
*Attorney, Agent, or Firm*—Harrington A. Lackey

[57] ABSTRACT

A daylight loader cover device adapted to cover the opening of the loader compartment of a photographic printing machine including a perimetric open frame having the same configuration and adapted to be mounted over the opening of the loader compartment. The rear opening in the frame is covered by a light-impervious curtain having a rear passage adapted to be opened and closed. The front opening of the frame is closed by a light-impervious front cover having at least one, and preferably two, sleeve appendages projecting from, and opening through the front cover. The sleeve appendages are provided with elastic cuffs and are adapted to be inverted so that they will receive the arms of the operator and permit the operator's hands to extend into substantially every portion of the antechamber between the front cover and the rear curtain, as well as to permit the operator's hands to extend and operate freely within the loader compartment of the photographic printing machine. The front cover also includes a front passage adapted to be opened and closed for introducing film and prints within the antechamber and the loader compartment.

9 Claims, 7 Drawing Figures

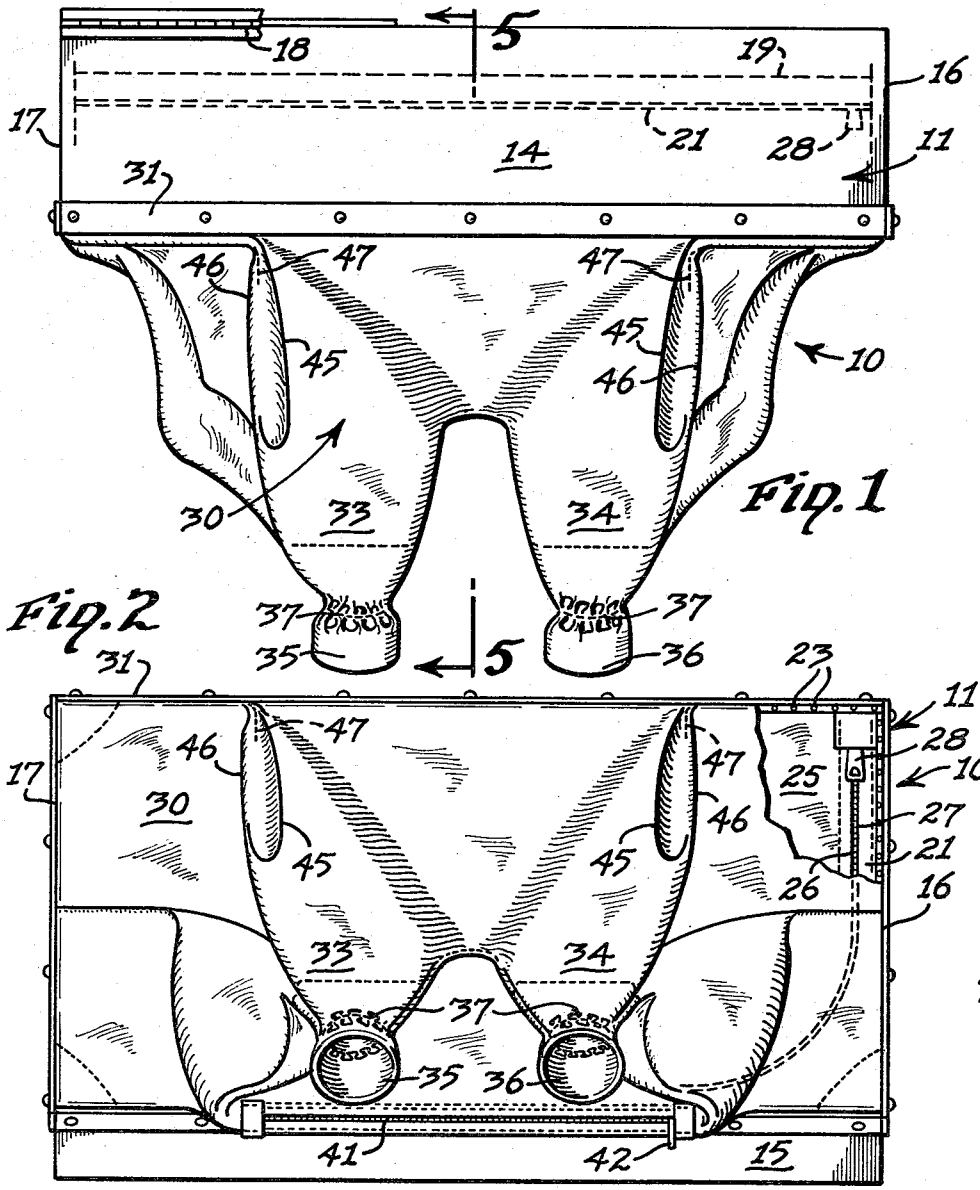
Fig. 1
Fig. 2
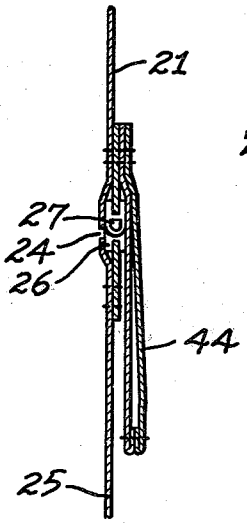
Fig. 6
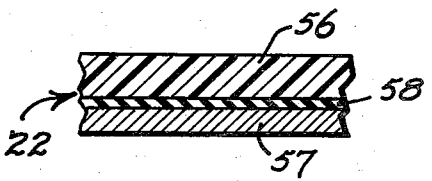
Fig. 7
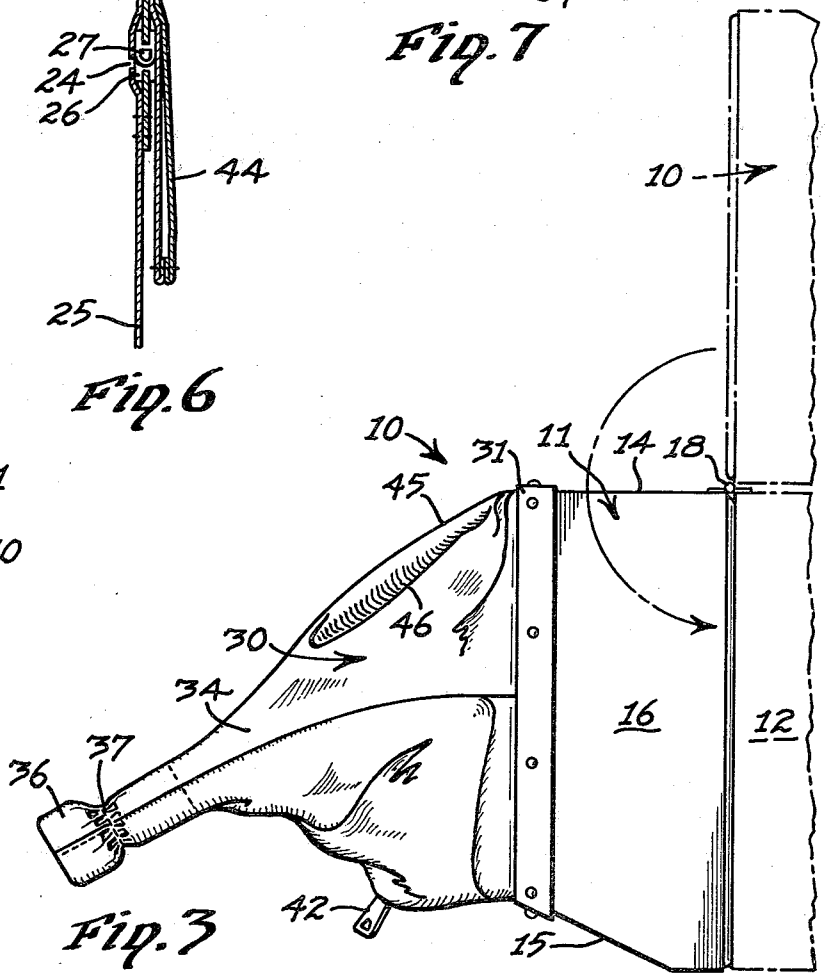
Fig. 3

DAYLIGHT LOADER COVER DEVICE FOR PHOTOGRAPHIC PRINTING MACHINE

BACKGROUND OF THE INVENTION

This invention relates to a cover device for the loader compartment of a photographic printing machine, and more particularly to a daylight loader cover device.

Photographic printing machines, particularly of the commercial type are usually located in darkrooms so that they may be loaded and unloaded without exposure to the light.

Some attempts have been made to fabricate cover devices for the opening of the loader compartment of the printing machine with little success in completely preventing the leakage of light into the loader compartment, while the film is being loaded or the prints are being unloaded.

SUMMARY OF THE INVENTION

It is therefore an object of this invention to provide a daylight loader cover device for covering the opening of a loader compartment of a photographic printing machine to completely exclude light from the loader compartment, and particularly while the operator is loading unexposed film into the machine and for removing prints of the film from the machine, without exposure of the film or the prints.

The daylight loader device made in accordance with this invention includes an open frame having substantially the same configuration and adapted to fit the opening of the loader compartment. The frame has a rear opening which is completely closed by a light-impervious curtain. The front opening of the frame is closed by a front cover member of flexible light-impervious material to provide an antechamber between the front cover and the rear curtain.

Projecting from, and forming a part of, the front cover is one or more, and preferably two, forward projecting sleeve appendages terminating in elastic cuffs. The sleeve members open into the antechamber and are adapted to be inverted, or turned wrongside out, to permit the operator's hands inserted within the cuff members to extend into and reach any portion of the antechamber, and also to project through a passage in the rear curtain into the loader compartment for freely manipulating the rolls of the film and prints within the loader compartment.

The rear passage within the rear curtain is adapted to be opened and closed for the transfer of film and prints between the loader compartment and the antechamber. A front passage is formed in the front cover also to permit the transfer of film and prints between the antechamber and the outside of the machine. The front and rear passages are also adapted to be opened and closed by means for completely preventing the passage of light through the respective passages when closed.

BRIEF DESCRIPTION OF THE DRAWINGS

FIG. 1 is a top plan view of the daylight loader cover device made in accordance with this invention, with the hinge member disclosed fragmentarily;

FIG. 2 is a front elevation of the cover device, with portions broken away;

FIG. 3 is a side elevation of the cover device hingedly mounted to a loader compartment, disclosed in phantom, of the photographic printing machine, the cover device being disclosed in its raised inoperative position in phantom;

FIG. 6 is an enlarged section taken along the line 6—6 of FIG. 4; and

FIG. 7 is greatly enlarged fragmentary cross-section of the preferred, laminated, light-impervious, material employed in the front cover and rear curtain.

DESCRIPTION OF THE PREFERRED EMBODIMENTS

Figure 5:
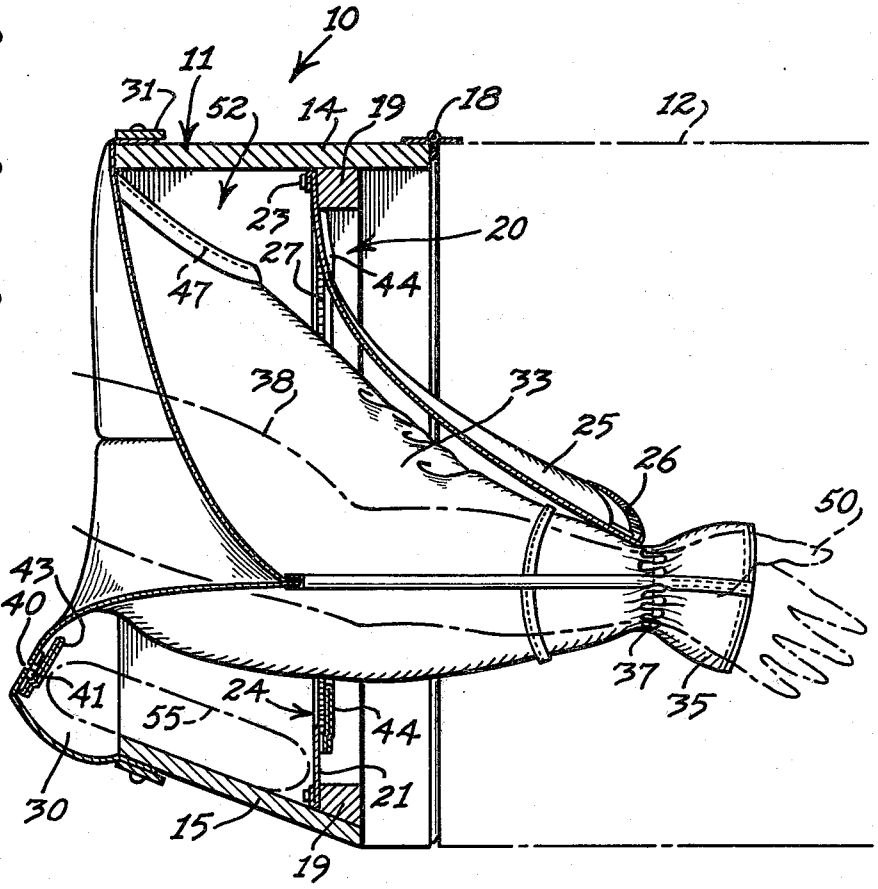
FIG. 5 is an enlarged section taken along the line 5—5 of FIG. 1, illustrating the cover device mounted upon the loader compartment in phantom, and one of the sleeve appendages inverted and receiving the arm of the operator, disclosed in phantom and projecting rearward through the antechamber and through the open rear passage of the rear curtain.
Figure 4:
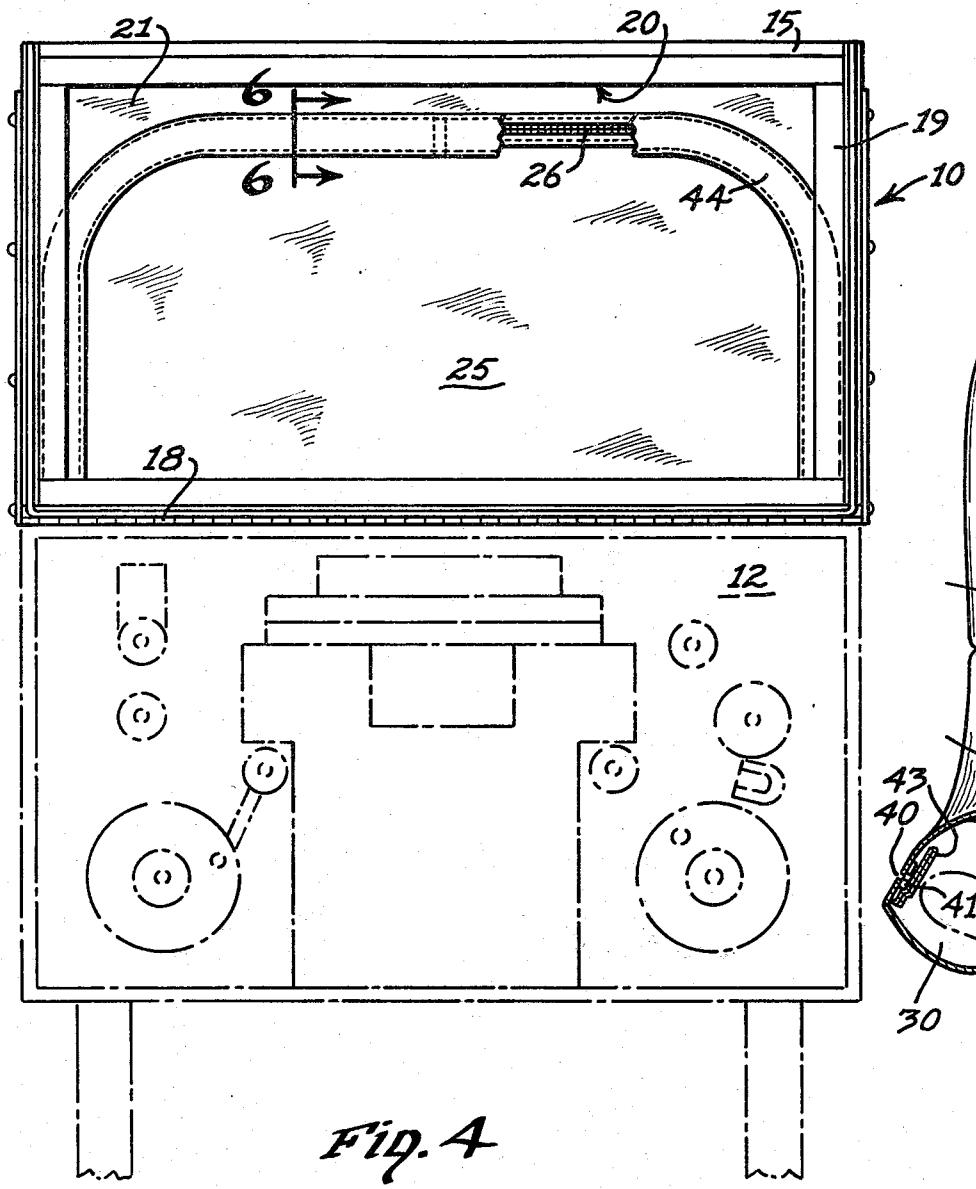
FIG. 4 is a front elevation of the loader compartment of the printing machine disclosed in phantom, and a rear elevation of the cover device disclosed in its elevated inoperative position, with portions of the rear slide fastener flap removed.

Referring now to the drawings in more detail, the daylight loader cover device 10 made in accordance with this invention includes a perimetric frame 11 of substantially rectangular shape and of substantially the same size and shape as the perimeter of the loader compartment 12 of the photographic printing machine disclosed in phantom in FIGS. 3, 4, and 5. The cover frame 11 includes a top wall 14, a sloping bottom wall 15 and side walls 16 and 17.

The top wall 14 of the frame 11 is pivotally mounted to the top of the loader compartment 12 by hinge means, such as a piano hinge 18, so that the frame 11 may be pivotally moved between the lower operative position, as disclosed in FIGS. 1–3, and upper inoperative position resting on top of the loader compartment 12, as illustrated in phantom in FIG. 3 and in solid lines in FIG. 4.

Fixed within the rear portion of the cover frame 11 is a curtain frame 19 defining a rear opening 20 and supporting a rear curtain 21. The rear curtain 21 is made of a flexible, light-impervious material, such as the material 22 disclosed in FIG. 7, and is secured around its peripheral margin to the curtain frame 19 by any convenient means, such as tacks 23.

Formed in the curtain 21 is a U-shaped slit or passage 24 defining a flexible flap 25, which, when swung rearward, enlarges the opening 24, as illustrated in FIG. 5. The edges of the slit 24 are secured to the opposed teeth 26 and 27 of a slide fastener or zipper 28 for opening and closing the rear passage 24.

Fixed to the perimeter of the front portion of the frame 11 is a front cover 30 made of the same flexible, light-impervious materal 22 as disclosed in FIG. 7. The perimeter of the front cover 30 is tightly secured to the perimeter of the frame 11 by securing framing strips 31.

The front cover 30 includes a pair of elongated and outwardly tapered sleeve appendages 33 and 34 which terminate in cuffs 35 and 36. Formed in the cuffs 35 and 36 are circumferential elastic constricting members 37 to fit about each wrist of the operator, when the operator's arm 38 (FIG. 5) is thrust through a sleeve appendage 33 or 34.

Formed in the lower portion of the front cover 30 is an elongated front passage 40 formed by a slit, to the edges of which are attached the teeth 41 of a front slide fastener 42.

Both the front passage 40 and the rear passage 24 are covered in their closed positions by a front flap 43 and a rear flap 44 made of light-impervious material, such as material 22, to assist in preventing the penetration of any light rays through the front passage 40 and the rear passage 24. One longitudinal edge of each flap 43 and 44 may be stitched or otherwise secured along and adjacent to one edge of the respective passage 24 and 40.

It will be noted that the entire center portion of the front cover 30 has sufficient fullness that it bulges forward, as indicated in FIGS. 2 and 3, to give greater flexibility and range of movement of operation of the operator's arm 38 behind the front cover 30.

The upper portion of each of the sleeve appendages 33 and 34 is provided with a pair of folds 45 and 46 which are stitched together at 47 to form bulging pleats. These pleats 45 and 46 provide a fullness which, when the sleeve appendage, such as appendage 33, is inverted or turned wrongside out, as illustrated in FIG. 5, and the hand 50 (FIG. 5) of the operator inserted through the appendage, the hand 50 is free to extend further to more remote areas of the antechamber 52 within the frame 11 between the front cover 30 and the rear curtain 21, than it would be possible without the pleats 45 and 46. As illustrated in FIG. 5, each sleeve appendage 33 and 34 is sufficiently long that, when inverted, and containing the arm 38 of the operator, the hand 50 may be extended rearward, not only through the antechamber 52, but also through the rear opening 20 into the loader compartment 12 for manipulating rolls of film and prints within the loading compartment 12.

In the operation of the cover device 10, the cover device 10 is first swung downward to its operative position as disclosed in FIG. 3. The rear slide fastener 28 is closed, the front slide fastener 42 is closed, and the sleeve appendages 33 and 34 project forward, rightside out, and hang downwardly, with the cuff openings being substantially constricted by the annular elastic members 37 to occlude light from the antechamber 52.

When it is desired to introduce an unexposed roll of film 55 (FIG. 5) into the loader compartment 12, the front slide fastener 42 is moved to the left of FIG. 2 in order to open the front passage 40. The film roll 55, which is protected by a light-impervious cover or casing, not shown, is introduced through the front passage 40 into the antechamber 52, and the front slide fastener 42 is then moved to the right to entirely close the front passage 40. The antechamber 52 is again completely closed to the introduction of any light rays.

The operator then thrusts one or both hands 50 through the corresponding cuffs 36 and 35 until each elastic member 37 securely grips a wrist, as indicated in FIG. 5. One of the operator's hands 50 then unfastens the rear slide fastener 28 so that the flap 25 may be moved rearward to enlarge the rear passage 24. The operator then removes the light-impervious cover, or bag (not shown) from the film roll 55 and loads it upon the appropriate spindle within the loader chamber 12. If there is a spool or roll of printed film in the loader compartment the operator removes it and covers it with an appropriate light-impervious casing or cover, not shown, and lays it down in the antechamber 52. The operator then moves the rear slide fastener 28 to close the flap 25. The operator then removes his arms 38 from the sleeve appendages 33 and 34, simultaneously restoring the sleeve appendages 33 and 34 to their rightside-out positions of FIG. 3 from their inside-out positions of FIG. 5. He then removes his hands 50, opens the slide fastener 42 and removes any film prints from the antechamber 52. The slide fastener 42 is then re-closed and the photographic printing machine is ready for operation, without any exposure of the film which was loaded or unloaded from the machine to any light rays.

A preferred form of the light-impervious flexible fabric material 20 includes an outer layer of woven nylon 56, an inner layer of woven cotton material 57 and an intermediate layer of rubber 58 bonded between the outer layer of woven nylon 56 and the inner layer of cotton material 57 by an appropriate adhesive.

The sleeve appendages 33 and 34 are each long enough to permit the operator's hands 50 to reach almost any position within the antechamber 52, particularly with the double pleats 45 and 46 permitting the extra extension of the inverted sleeve appendages 33 and 34. Thus, each sleeve appendage 33 and 34 is long enough to extend laterally in inside-out position substantially to either side wall 16 or 17 within the antechamber 52.

What is claimed is:

1. A daylight loader cover device adapted to cover the opening of the loader compartment of a photographic printing machine comprising:

(a) an open frame having a perimetric, light-impervious wall and spaced front and rear openings, (b) means for mounting said frame upon the loader compartment so that said rear opening registers with the opening of the loader compartment in operative position, (c) a rear curtain of light-impervious material attached to said frame closing said rear opening, (d) a rear passage through said curtain, and means for opening and closing said passage, (e) a front cover of flexible, light-impervious material attached to said frame and spaced in front of said rear curtain to form an antechamber between said front cover and said rear curtain, (f) at least one flexible sleeve appendage projecting from and opening through said front cover and terminating in a cuff having a wrist opening, adapted to snugly fit around the wrist of a person loading the machine, said sleeve appendage being capable of being inverted and being long enough when inverted to project rearward through said antechamber and said curtain passage into the loader compartment of the photographic printing machine in operative position, and (g) a front passage through said front cover, and means for opening and closing said front passage.

2. The invention according to claim 1 in which said means for opening and closing said rear passage comprises rear slide fastener means, and the means for opening and closing said front passage comprises front slide fastener means.

3. The invention according to claim 2 in which each of said rear and front slide fastener means comprises an elongated, light-impervious flap concealing said respective slide fasteners when closing said respective passages.

4. The invention according to claim 1 in which said cuff comprises a circumferential elastic member adapted to substantially constrict said wrist opening.

5. The invention according to claim 1 in which portions of said sleeve appendage are folded and pleated to provide greater fullness and flexibility of said sleeve appendage when inverted.

6. The invention according to claim 1 in which the length of said sleeve appendage permits it to project, inside out, to substantially any portion of said antechamber.

7. The invention according to claim 1 comprising two of said flexible sleeve appendages spaced apart in the middle portion of said front cover, either one or both of the cuffs of said sleeve appendages being capable of being positioned in any portion of said antechamber.

8. The invention according to claim 1 in which said mounting means comprises hinge means securing the upper portion of said frame to the upper portion of the opening of the loader compartment of a photographic printing machine, whereby said daylight loader cover device may be raised and lowered about the axis of said hinge means for opening and closing the loader compartment.

9. The invention according to claim 1 in which said rear passage is U-shaped to define a flap portion of said rear curtain for opening and closing said rear passsage.

* * * * *